US007547275B2

(12) United States Patent
Cho et al.

(10) Patent No.: US 7,547,275 B2
(45) Date of Patent: Jun. 16, 2009

(54) MIDDLE EAR IMPLANT TRANSDUCER

(75) Inventors: Jin Ho Cho, Daegu (KR); Byung Seop Song, Daegu (KR); Min Gyu Kim, Daegu (KR)

(73) Assignee: Kyungpook National University Industrial Collaboration Foundation, Daegu (KR)

( * ) Notice: Subject to any disclaimer, the term of this patent is extended or adjusted under 35 U.S.C. 154(b) by 869 days.

(21) Appl. No.: 10/952,520

(22) Filed: Sep. 27, 2004

(65) Prior Publication Data

US 2005/0090705 A1 Apr. 28, 2005

(30) Foreign Application Priority Data

Oct. 25, 2003 (KR) ..... 10-2003-0074914

(51) Int. Cl.
*H04R 25/00* (2006.01)

(52) U.S. Cl. ..... 600/25

(58) Field of Classification Search ..... 600/23, 600/25; 607/55–57; 381/23.1, 322, 324, 381/326, 380
See application file for complete search history.

(56) References Cited

U.S. PATENT DOCUMENTS 6,735,318 B2 5/2004 Cho ..... 381/326
2004/0097785 A1* 5/2004 Schmid et al. ..... 600/25

* cited by examiner

*Primary Examiner*—Charles A Marmor, II
*Assistant Examiner*—Christine D Hopkins
(74) *Attorney, Agent, or Firm*—Lowe, Hauptman, Ham & Berner, LLP

(57) ABSTRACT

A middle ear implant transducer of a hearing aid includes: first and second permanent magnets arranged such that the same poles of the first and second permanent magnets face each other; first and second vibrating members attached to both edges of the respective first and second permanent magnets; a coil enclosing the first and second permanent magnets and being separated a predetermined distance from the outer surfaces of the first and second permanent magnets between the first vibrating member and the second vibrating member; and first and second covers mounted on the outer surfaces of the first and second vibrating members, wherein the first and second vibrating members comprise couplers respectively attached to the first and second permanent magnets, rims respectively attached to the edges of the first and second covers, and support films respectively connecting the couplers to the rims and being thinner than the couplers and the rims.

5 Claims, 7 Drawing Sheets

MIDDLE EAR IMPLANT TRANSDUCER

BACKGROUND OF THE INVENTION

This application claims the priority of Korean Patent Application No. 2003-74914, filed on Oct. 25, 2003, in the Korean Intellectual Property Office, the disclosure of which is incorporated herein in its entirety by reference.

1. Field of the Invention

The present invention relates to a middle ear implant transducer of a hearing aid.

2. Description of the Related Art

A middle ear implant transducer of a hearing aid, which is a core part of an artificial middle ear, is directly implanted into the ossicular chain in a middle ear of a patient having a hearing disorder by surgery and is extensively used to remedy extreme conductive hearing loss, sensorineural hearing loss, or mixed hearing loss.

A transducer can prevent noise caused by an external magnetic field with excellent efficiency. A transducer includes two identical tubular permanent magnets in the center of a tubular coil such that the same poles of the permanent magnets face each other. The permanent magnets and the coil are connected by a vibrating member. A conventional transducer is disclosed in Korea Pat. No. 10-2003-74914 and U.S. Pat. No. 6,735,318 submitted by the current applicant. The permanent magnets vibrate in response to variations in a magnet flux generated by the coil, and the vibration of the permanent magnets is transmitted to the transducer via the vibrating member causing the transducer to vibrate. Since such a middle ear implant transducer directly transmits vibrations corresponding to a sound signal to the middle ear, distortion is small, and hauling due to sound feedback is also small.

Despite the above advantages, a possibility of generating distortion when vibration characteristics of the transducer are different from those of the middle ear exists. In particular, when a resonance frequency or a vibration displacement of the vibration characteristics of the transducer is different from that of the middle ear, severe distortion may be generated.

SUMMARY OF THE INVENTION

The present invention provides a middle ear implant transducer having vibration characteristics similar to those of a middle ear and a method of manufacturing a vibrating member adapted to the transducer.

According to an aspect of the present invention, there is provided a middle ear implant transducer of a hearing aid comprising: first and second permanent magnets arranged such that the same poles of the first and second permanent magnets face each other; first and second vibrating members attached to both edges of the respective first and second permanent magnets; a coil enclosing the first and second permanent magnets and being separated a predetermined distance from the outer surfaces of the first and second permanent magnets between the first vibrating member and the second vibrating member; and first and second covers mounted on the outer surfaces of the first and second vibrating members, wherein the first and second vibrating members comprise couplers respectively attached to the first and second permanent magnets, rims respectively attached to the edges of the first and second covers, and support films respectively connecting the couplers to the rims and being thinner than the couplers and the rims.

The support film may comprise a plurality of support film wings having constant widths.

The support film may comprise a plurality of support film wings having widths that increase from the coupler to the rim.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

Hereinafter, the present invention will now be described more fully with reference to the accompanying drawings, in which embodiments of the invention are shown.

Figure 1:
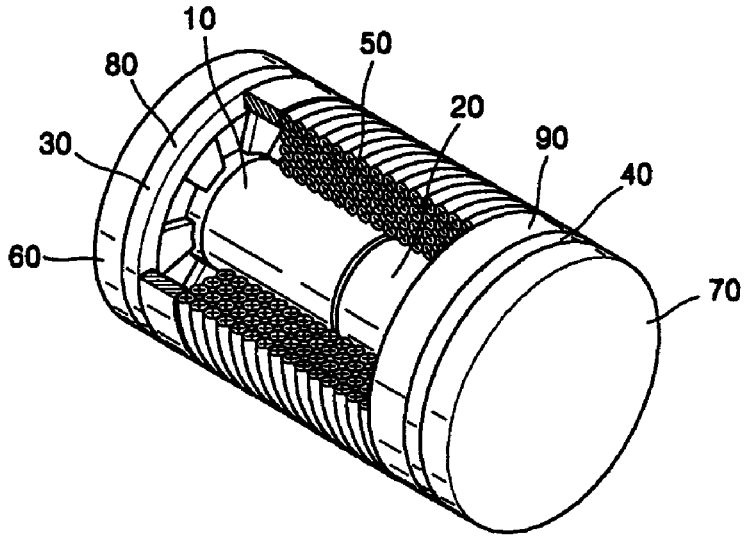
FIG. 1 is a perspective view of a middle ear implant transducer to which a vibrating member is adapted according to an embodiment of the present invention.
Figure 2:
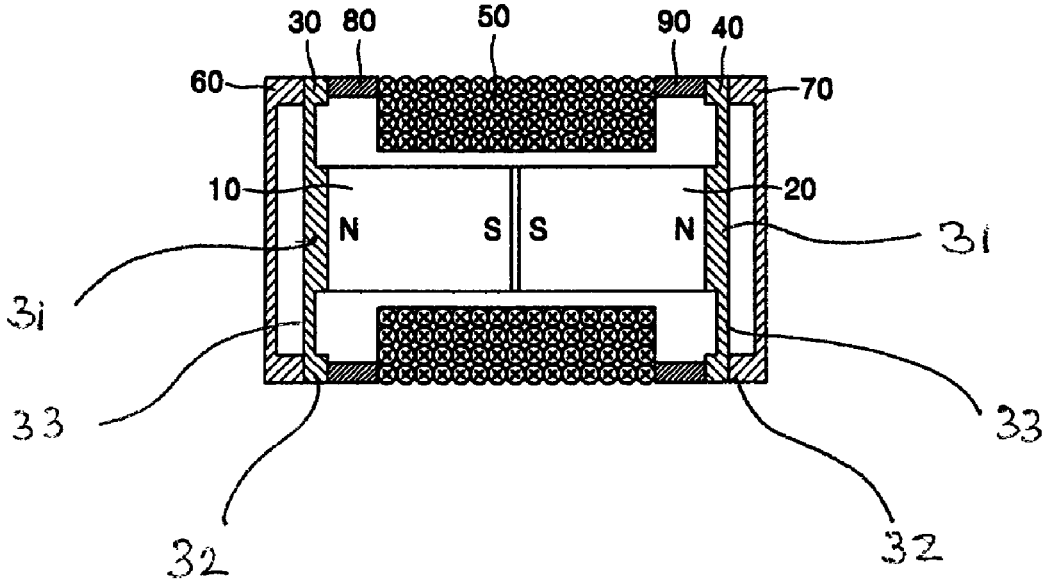
FIG. 2 is a sectional view of the middle ear implant transducer of FIG. 1.
Figure 3:
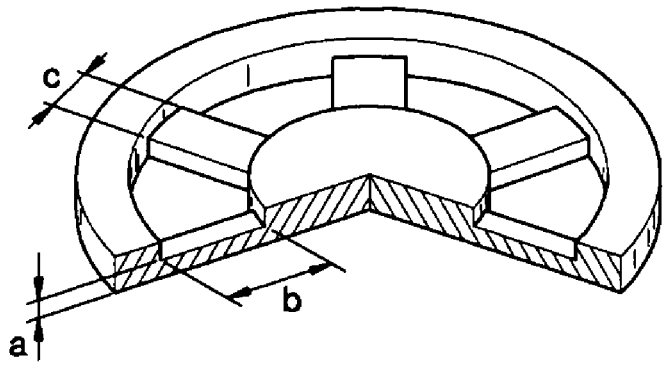
FIG. 3 is an exploded perspective view of the vibrating member adapted to the middle ear implant transducer of FIG. 1.
Figure 4:
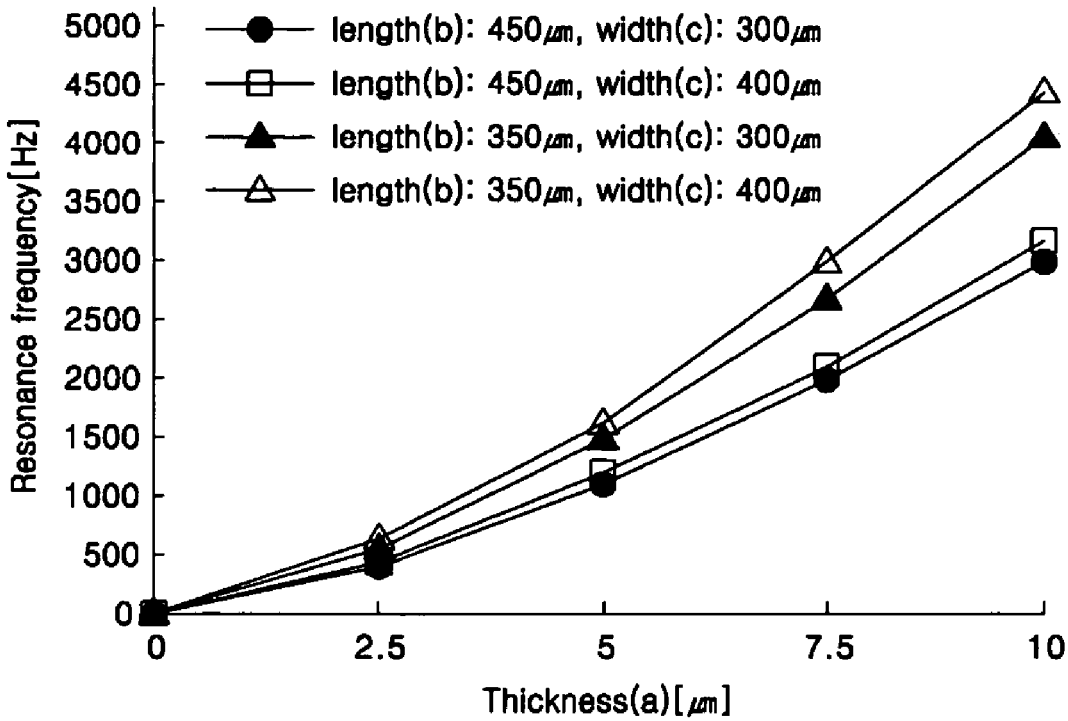
FIG. 4 is a graph illustrating a resonance frequency according to the thickness of a support film wing for various lengths and widths of the support film wing.

FIG. 1 is a perspective view of a middle ear implant transducer to which a vibrating member is adapted according to an embodiment of the present invention. FIG. 2 is a sectional view of the middle ear implant transducer of FIG. 1. FIG. 3 is an exploded perspective view of the vibrating member adapted to the middle ear implant transducer of FIG. 1. FIG. 4 is a graph illustrating a resonance frequency according to the thickness of a support film wing for various lengths and widths of the support film wing.

As shown in FIGS. 1 through 4, the transducer includes first and second permanent magnets 10 and 20 arranged with the same poles facing each other; first and second vibrating members 30 and 40 attached to both edges of the respective first and second permanent magnets 10 and 20. A coil 50 is winded around the first and second permanent magnets 10 and 20 between the first vibrating member 30 and the second vibrating member 40. The coil is separated a predetermined distance from the outer surfaces of the first and second permanent magnets 10 and 20. First and second covers 60 and 70 are mounted on the outer surfaces of the first and second vibrating members 30 and 40. Rings 80 and 90 are interposed between the first and second vibrating members 30 and 40 and the coil 50, and separated from the first and second permanent magnets 10 and 20 by a predetermined distance.

The first and second vibrating members 30 and 40 include coupler 31 attached to the first and second permanent magnets 10 and 20. Rims 32 are attached to the edges of the first and second covers 60 and 70. Support films 33 connect the couplers 31 to the rims 32 and have smaller thicknesses than the couplers 31, and the rims 32.

In a hearing aid including the transducer, an external unit attached to a patient's body receives external sound waves and generates electrical signals corresponding to the external sound waves. The electrical signals are transmitted to the coil 50 of the transducer and converted into a magnetic flux. The magnetic flux vibrates the first and second permanent magnets 10 and 20. The vibration of the first and second permanent magnets 10 and 20 is transmitted to the entire transducer via the first and second vibrating members 30 and 40. The vibration of the transducer vibrates the middle ear. Accordingly, a patient having a hearing disorder can perceive sound transmitted from the outside.

When a characteristic of the transducer is different from that of the middle ear, e.g., a resonance frequency or a vibration displacement, sound distortion is generated. This sound distortion can be compensated for by the first and second vibrating members 30 and 40 transmitting the vibration of the first and second permanent magnets 10 and 20.

In each of the first and second vibrating members 30 and 40, the resonance frequency is high when the thickness a of each of the support films 33 and 43 is large and low when the thickness a is small. However, the vibration displacement is low when the thickness a is large and high when the thickness a is small. That is, the resonance frequency is inversely proportional to the vibration displacement. The correlation between the resonance frequency and the vibration displacement will now be described in detail.

The resonance frequency is proportional to the square root of the cube of the thickness a of a support film, and the vibration displacement is inversely proportional to the cube of the thickness a of the support film. That is, when the thickness a of the support film is increased, the resonance frequency is increased, and the vibration displacement is decreased.

On the other hand, when the support film is divided into a plurality of support film wings, the resonance frequency is inversely proportional to the square root of the cube of the length b of the support film wing, and the vibration displacement is proportional to the double square of the length b of the support film wing. That is, when the length b of the support film wing is increased, the resonance frequency is decreased, and the vibration displacement is increased.

The resonance frequency is proportional to the square root of the width c of the support film wing, and the vibration displacement is inversely proportional to the width c of the support film wing. That is, when the width c of the support film wing is increased, the resonance frequency is increased, and the vibration displacement is decreased.

A graph illustrating the resonance frequency according to the thickness a of the support film wing for various lengths and widths of the support film wing is shown in FIG. 4.

The resonance frequency or the vibration displacement of the vibrating member varies according to the thickness a of the support film and the length b and the width c of the support film wing. Accordingly, various types of vibrating members can be realized. That is, even if transducers are implanted into patients with different vibration characteristics, a transducer corresponding to the vibration characteristics can be realized. Here, the first and second vibrating members 30 and 40 suitable for the various vibration characteristics will be described. However, in order to describe the first and second vibrating members 30 and 40 more easily, the first and second vibrating members 30 and 40 will be simply called a vibrating member.

Figure 5:
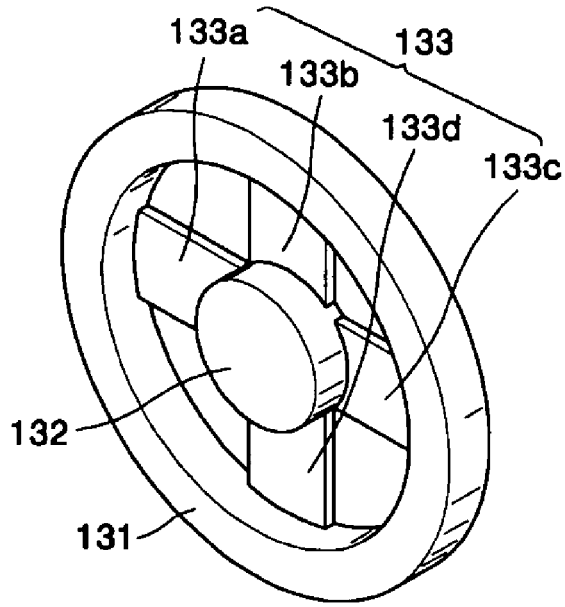
FIG. 5 is a perspective view of a vibrating member adapted to the middle ear implant transducer of FIG. 1 according to a first embodiment of the present invention.

FIG. 5 is a perspective view of a vibrating member adapted to the middle ear implant transducer of FIG. 1 according to a first embodiment of the present invention. Referring to FIG. 5, a vibrating member 130 includes a coupler 131 attached to first and second permanent magnets, a rim 132 attached to edges of first and second covers, and a support film 133 connecting the coupler 131 and the rim 132. The support film 133 includes a plurality of support film wings. In the present embodiment, the support film 133 includes four support film wings 133*a*, 133*b*, 133*c*, and 133*d*. However, the number of support film wings may be more or less, such as six or eight.

Figure 6:
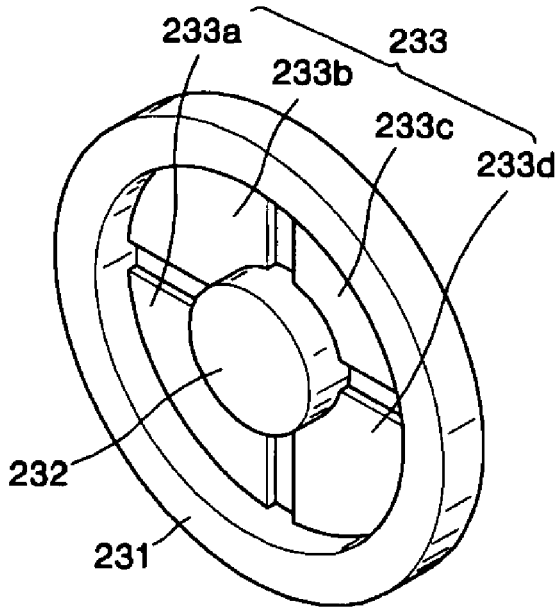
FIG. 6 is a perspective view of a vibrating member adapted to the middle ear implant transducer of FIG. 1 according to a second embodiment of the present invention.

FIG. 6 is a perspective view of a vibrating member adapted to the middle ear implant transducer of FIG. 1 according to a second embodiment of the present invention. Referring to FIG. 6, a vibrating member 230 includes a coupler 231 attached to first and second permanent magnets, a rim 232 attached to edges of first and second covers, and a support film 233 connecting the coupler 231 and the rim 232. The support film 233 includes a plurality of support film wings with widths that increase from the coupler 231 to the rim 232. In the present embodiment, the support film 233 includes four support film wings 233*a*, 233*b*, 233*c*, and 233*d*. However, the number of support film wings may be more or less, such as six or eight.

Figure 7:
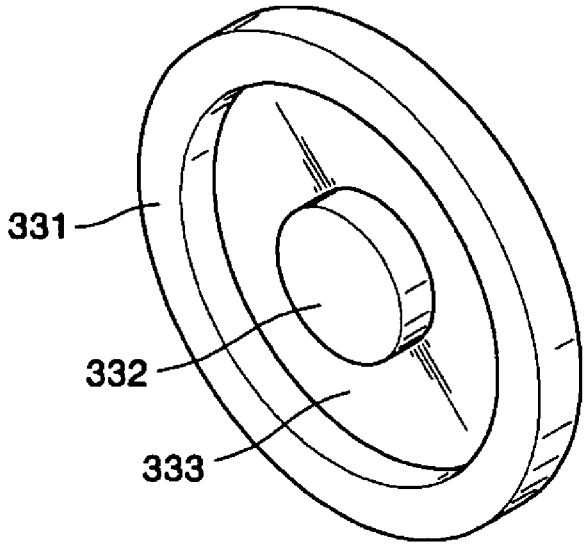
FIG. 7 is a perspective view of a vibrating member adapted to the middle ear implant transducer of FIG. 1 according to a third embodiment of the present invention.

FIG. 7 is a perspective view of a vibrating member adapted to the middle ear implant transducer of FIG. 1 according to a third embodiment of the present invention. Referring to FIG. 7, a vibrating member 330 includes a coupler 331 attached to first and second permanent magnets, a rim 332 attached to edges of first and second covers, and a support film 333 connecting the coupler 331 and the rim 332. The support film 333 is thinner than the coupler 331 and the rim 332. Accordingly, vibration of the coupler 331 is easily transmitted to the rim 332.

The support film may be composed of silicon. The support film can also be composed of polyimide.

A method of manufacturing a vibrating member adapted to a middle ear implant transducer of a hearing aid according to an embodiment of the present invention will now be described with reference to FIGS. 8 through 11.

Figure 8:
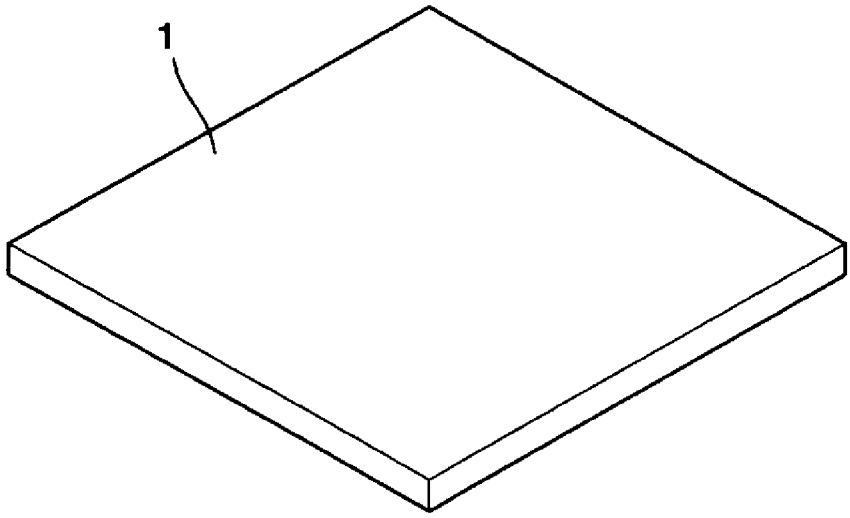
FIG. 8 is a perspective view illustrating a first process of manufacturing a vibrating member according to an embodiment of the present invention.

Referring to FIG. 8, a silicon wafer 1 with both surfaces treated is prepared. The silicon wafer 1 is a crystalline silicon substrate composed of monocrystalline silicon as a raw material. The surface of the silicon wafer 1 must be polished to achieve a high degree of flatness.

Figure 9:
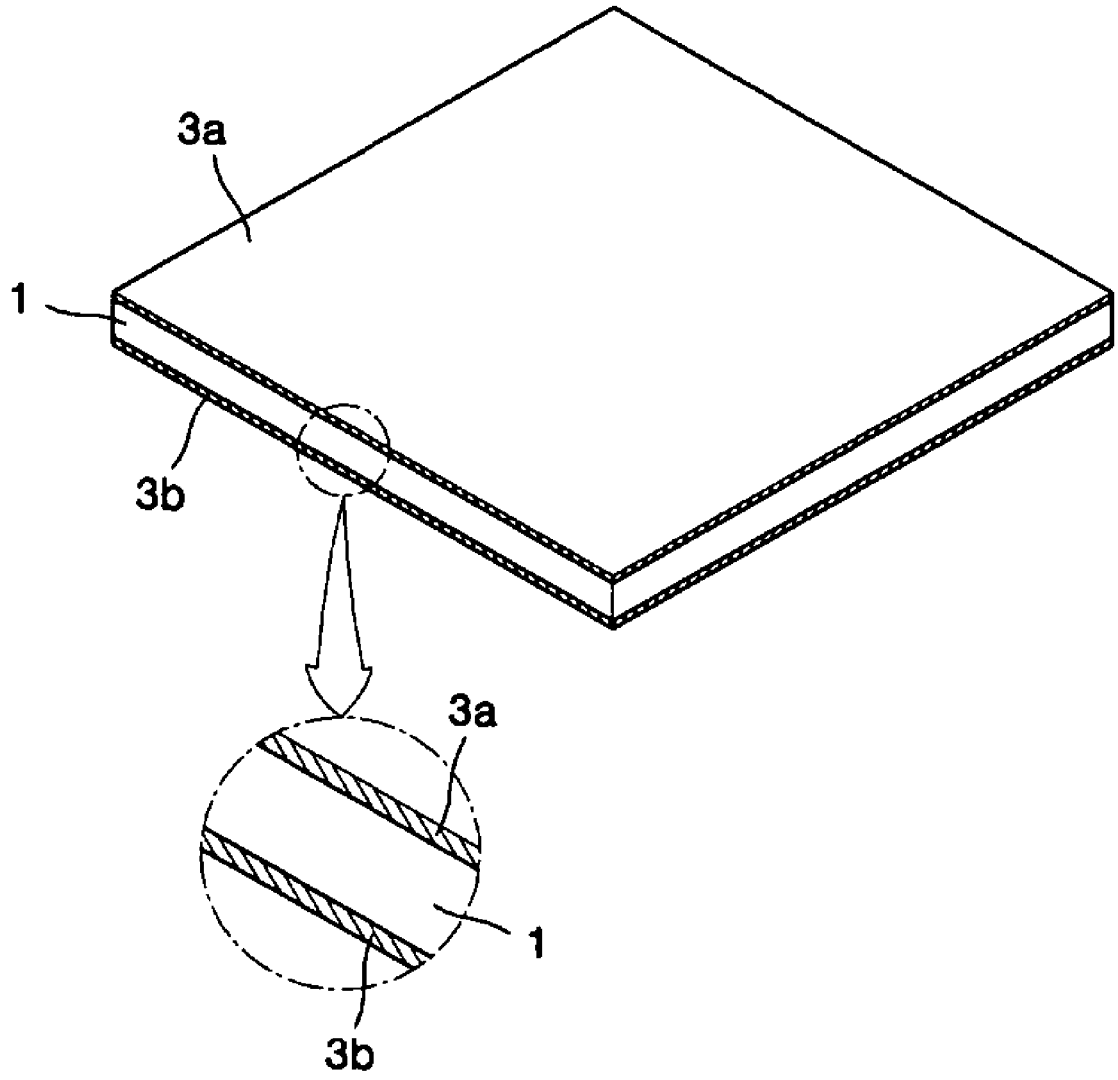
FIG. 9 is a perspective view illustrating a second process following the first process illustrated by FIG. 8.

Referring to FIG. 9, first and second polymer films 3*a* and 3*b* on respective surfaces of the silicon wafer 1 are formed. In detail, liquid polyimide is evenly coated on both of the surfaces of the silicon wafer 1 using a spinner, and the silicon wafer 1 is softly baked. That is, the silicon wafer 1 is baked in an oven at 90° C. for 30 minutes. Accordingly, the polymer films 3*a* and 3*b* are formed on both of the surfaces of the silicon wafer 1.

Figure 10A:
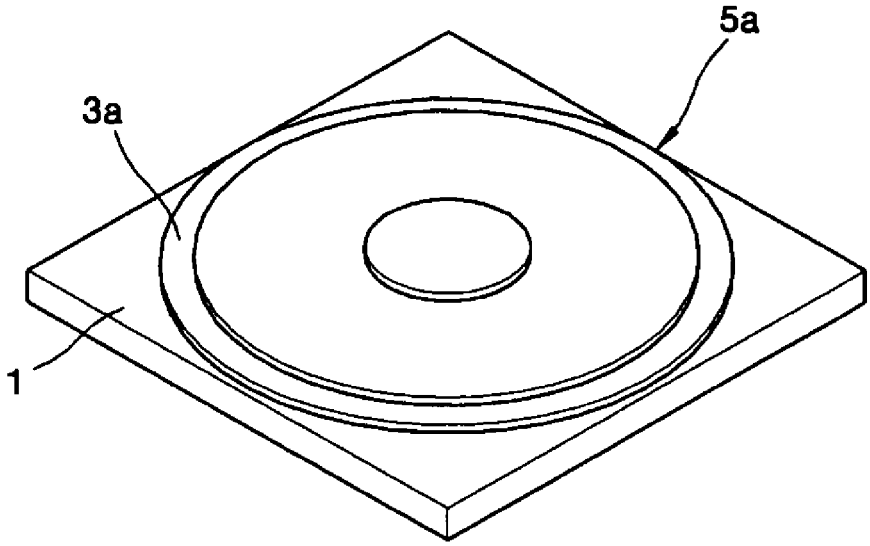
FIGS. 10A and 10B are perspective views of illustrating a third process following the second process illustrated by FIG. 9.
Figure 10B:
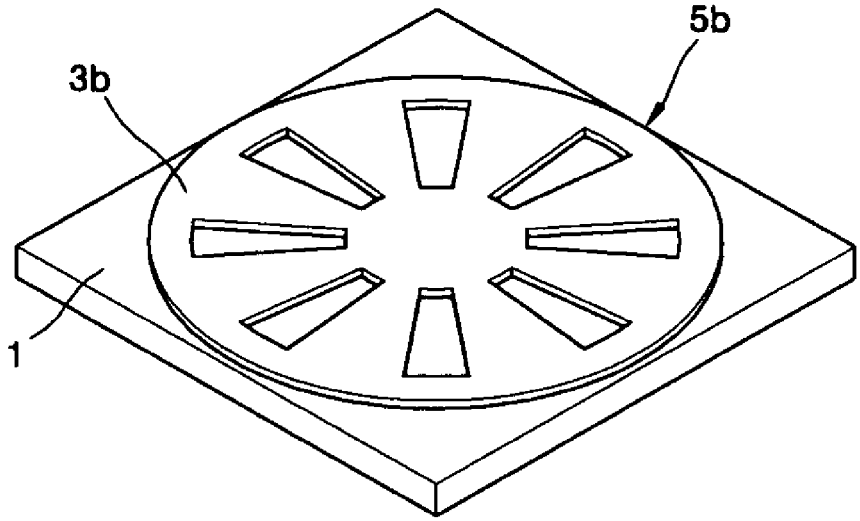

Referring to FIGS. 10A and 10B, a first pattern 5*a* corresponding to a top portion of a vibrating member is formed on the first polymer film 3*a* and a second pattern 5*b* corresponding to a bottom portion of the vibrating member is formed on the second polymer film 3*b*. In detail, a mask on which the first pattern 5*a* is formed and another mask on which the second pattern 5*b* is formed are attached to the respective polymer films 3*a* and 3*b*, and then the first and second patterns 5*a* and 5*b* are formed by radiating ultraviolet rays onto the masks.

Figure 11A:
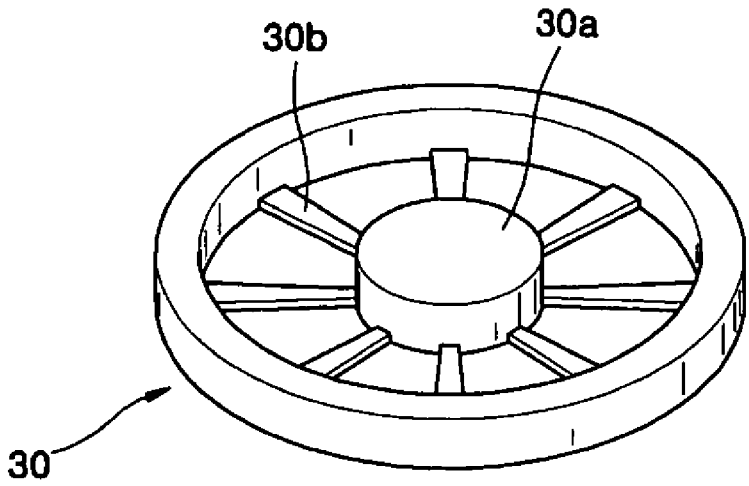
FIGS. 11A and 11B are perspective views of illustrating a fourth process following the third process illustrated by FIGS. 10A and 10B.
Figure 11B:
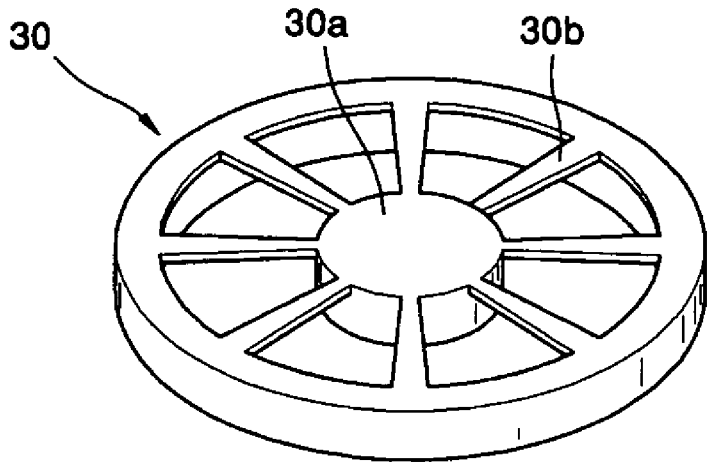

Referring to FIGS. 11A and 11B, the silicon wafer 1 is etched by using the first pattern 5*a* and the second pattern 5*b* as masks. That is, the top portion of the vibrating member 30 shown in FIG. 11A is formed, and the bottom portion of the vibrating member 30 shown in FIG. 11B is formed. Accordingly, the vibrating member 30 is completed.

As described above, a middle ear implant transducer according to an embodiment of the present invention can be adapted to any patient with a hearing disorder having any vibration characteristics by varying vibration characteristics of a vibrating member of the transducer by changing the thickness of a support film and lengths and widths of support film wings. Also, since vibrating members having the same characteristics can be mass-produced using a semiconductor manufacturing process, transducers having the same vibration characteristics can be mass-produced.

While this invention has been particularly shown and described with reference to preferred embodiments thereof, it will be understood by those skilled in the art that various changes in form and details may be made therein without departing from the spirit and scope of the invention as defined by the appended claims. The preferred embodiments should be considered in descriptive sense only and not for purposes of limitation. Therefore, the scope of the invention is defined not by the detailed description of the invention but by the appended claims, and all differences within the scope will be construed as being included in the present invention.

What is claimed is:

1. A middle ear implant transducer of a hearing aid, said middle ear implant transducer comprising:

first and second permanent magnets arranged such that the same poles of the first and second permanent magnets face each other;

first and second vibrating members attached to the first and second permanent magnets, respectively;

a coil enclosing the first and second permanent magnets, separated a predetermined distance from outer surfaces of the first and second permanent magnets, and located between the first vibrating member and the second vibrating member; and first and second covers mounted on the first and second vibrating members, respectively;

wherein each of the first and second vibrating members comprises:

a coupler attached to the respective first or second permanent magnet, a rim attached to the respective first or second cover, and a support film connecting the coupler to the rim, and being thinner than the coupler and the rim.

2. The middle ear implant transducer of claim 1, wherein, in each of the first and second vibrating members, the support film comprises a plurality of support film wings having constant widths.

3. The middle ear implant transducer of claim 1, wherein, in each of the first and second vibrating members, the support film comprises a plurality of support film wings having widths that increase from the coupler to the rim.

4. The middle ear implant transducer of claim 1, wherein each of the first and second permanent magnets has axially opposite inner and outer end faces, and the inner end faces of the first and second permanent magnets face each other; and the coupler of each of the first and second vibrating members has an inner surface directly attached to the outer end face of the respective first or second permanent magnet.

5. The middle ear implant transducer of claim 1, having only one said coil.

* * * * *